US007587874B2

(12) United States Patent
Hohmann, Jr.

(10) Patent No.: US 7,587,874 B2
(45) Date of Patent: Sep. 15, 2009

(54) HIGH-STRENGTH SURFACE-MOUNTED ANCHORS AND WALL ANCHOR SYSTEMS USING THE SAME

(75) Inventor: Ronald P. Hohmann, Jr., Hauppauge, NY (US)

(73) Assignee: MiTek Holdings, Inc., Wilmington, DE (US)

( * ) Notice: Subject to any disclaimer, the term of this patent is extended or adjusted under 35 U.S.C. 154(b) by 787 days.

(21) Appl. No.: 10/785,209

(22) Filed: Feb. 24, 2004

(65) Prior Publication Data

US 2004/0216408 A1 Nov. 4, 2004

Related U.S. Application Data

(63) Continuation-in-part of application No. 10/426,993, filed on Apr. 30, 2003, now Pat. No. 6,925,768.

(51) Int. Cl.
*E04B 1/38* (2006.01)
*E04B 1/02* (2006.01)

(52) U.S. Cl. ..... 52/714; 52/565

(58) Field of Classification Search ..... 52/713, 52/714, 508, 513, 379, 383, 565
See application file for complete search history.

(56) References Cited

U.S. PATENT DOCUMENTS

| | | | | |
|---|---|---|---|---|
| 1,854,633 A | * | 4/1932 | Stephens | 52/215 |
| 2,058,148 A | | 10/1936 | Hard | 52/714 |
| 2,966,705 A | | 1/1961 | Massey | 52/714 |
| 3,154,889 A | * | 11/1964 | Monroe | 52/249 |
| 3,377,764 A | | 4/1968 | Storch | |
| 4,021,990 A | | 5/1977 | Schwalberg | 52/714 |
| 4,305,239 A | | 12/1981 | Geraghty | 52/715 |
| 4,373,314 A | | 2/1983 | Allan | 52/434 |
| 4,438,611 A | | 3/1984 | Bryant | 52/309.2 |
| 4,473,984 A | | 10/1984 | Lopez | 52/410 |

(Continued)

FOREIGN PATENT DOCUMENTS

| | | |
|---|---|---|
| CH | 279209 | 3/1952 |

(Continued)

OTHER PUBLICATIONS

Definition of Inboard: www.boatlodge.com/nautical2.htm.*

(Continued)

*Primary Examiner*—Brian E Glessner
*Assistant Examiner*—Adriana Figueroa
(74) *Attorney, Agent, or Firm*—Siegmar Silber, Esq.

(57) ABSTRACT

A folded wall anchor and an anchoring system employing the same are disclosed. The anchor is a folded sheetmetal construct utilizable with various wire formative veneer ties. The folded wall tie enables the junctures of the legs and the base of the wall anchor to be located inboard from the periphery of the wall anchor and the legs to fully or partially sheath the mounting hardware. The sheathing function unifies the openings in the insulation required for installation and forms an anchoring system that is less intrusive. Upon installation with the surfaces of the enfolded leg and of the base coplanar, the leg and mounting hardware insertion point is sealed thereby. This sealing precludes penetration of air, moisture, and water vapor into the wall structure. Various embodiments show wall anchor configurations with suitable veneer ties and differing sheathing arrangements.

18 Claims, 9 Drawing Sheets

U.S. PATENT DOCUMENTS

| | | | | | |
|---|---|---|---|---|---|
| 4,598,518 | A | | 7/1986 | Hohmann | 52/410 |
| 4,869,038 | A | | 9/1989 | Catani | 52/410 |
| 4,875,319 | A | | 10/1989 | Hohmann | 52/383 |
| 5,035,099 | A | * | 7/1991 | Lapish | 52/713 |
| 5,063,722 | A | | 11/1991 | Hohmann | 52/410 |
| 5,186,571 | A | * | 2/1993 | Hentzschel | 403/231 |
| 5,392,581 | A | | 2/1995 | Hatzinikolas et al. | 52/712 |
| 5,408,798 | A | | 4/1995 | Hohmann | 52/562 |
| 5,454,200 | A | * | 10/1995 | Hohmann | 52/513 |
| 5,456,052 | A | | 10/1995 | Anderson et al. | 52/713 |
| 5,598,680 | A | * | 2/1997 | Wilhelmi | 52/715 |
| 5,816,008 | A | | 10/1998 | Hohmann | 52/565 |
| 5,846,018 | A | * | 12/1998 | Frobosilo et al. | 403/403 |
| 6,098,364 | A | * | 8/2000 | Liu | 52/506.08 |
| 6,209,281 | B1 | | 4/2001 | Rice | 52/714 |
| 6,279,283 | B1 | | 8/2001 | Hohmann et al. | 52/379 |
| 6,688,069 | B2 | * | 2/2004 | Zadeh | 52/715 |
| 6,726,155 | B1 | * | 4/2004 | Zimmerman | 248/48.1 |
| 6,925,768 | B2 | * | 8/2005 | Hohmann et al. | 52/513 |
| 6,941,717 | B2 | * | 9/2005 | Hohmann et al. | 52/506.01 |

FOREIGN PATENT DOCUMENTS

| | | |
|---|---|---|
| GB | 2069024 | 8/1981 |

OTHER PUBLICATIONS

Building Envelope Requirements, 780 CMR§1304.0 *et seq.* of Chapter 13; Boston, MA, Jan. 1, 2001.
Dur-o-Wal, Inc., Product Catalog (Aurora, Il; 2000).
Wire Bond Corp.; Product Catalog (Charlotte, NC; 2002/2003).
Hohmann & Barnard, Inc.; Product Catalog (Hauppauge, NY; 2002).
Blok-Lok, Ltd.; Product Catalog (Weston, Ont, Canada; 1991).

* cited by examiner

HIGH-STRENGTH SURFACE-MOUNTED ANCHORS AND WALL ANCHOR SYSTEMS USING THE SAME

CROSS-REFERENCES TO RELATED APPLICATIONS

This application is a continuation-in-part of U.S. patent application Ser. No. 10/426,993, entitled FOLDED WALL ANCHOR AND SURFACE-MOUNTED ANCHORING, filed Apr. 30, 2003, now U.S. Pat. 6,925,768.

BACKGROUND OF THE INVENTION

1. Field of the Invention

This invention relates to high-strength wall anchors and to surface-mounted anchoring systems employing the same, both of which are used in cavity wall constructs. More particularly, the invention relates to sheetmetal wall anchors and wire formative veneer ties that comprise positive interlocking components of the anchoring system. The system has application to seismic-resistant structures and to cavity walls having special requirements. The latter include high-strength requirements for both insulated and non-insulated cavities, namely, a structural performance characteristic capable of withstanding a 100 lbf, in both tension and compression.

2. Description of the Prior Art

In the late 1980's, surface-mounted wall anchors were developed by Hohmann & Barnard, Inc., and patented under U.S. Pat. No. 4,598,518 of the first-named inventor hereof. The invention was commercialized under trademarks DW-10, DW-10-X, and DW-10-HS. These widely accepted building specialty products were designed primarily for dry-wall construction, but were also used with masonry backup walls. For seismic applications, it was common practice to use these wall anchors as part of the DW-10 Seismiclip interlock system which added a Byna-Tie wire formative, a Seismiclip snap-in device—described in U.S. Pat. No. 4,875,319 ('319), and a continuous wire reinforcement.

In an insulated dry wall application, the surface-mounted wall anchor of the above-described system has pronged legs that pierce the insulation and the wallboard and rest against the metal stud to provide mechanical stability in a four-point landing arrangement. The vertical slot of the wall anchor enables the mason to have the wire tie adjustably positioned along a pathway of up to 3.625-inch (max.). The interlock system served well and received high scores in testing and engineering evaluations which examined effects of various forces, particularly lateral forces, upon brick veneer masonry construction. However, under certain conditions, the system did not sufficiently maintain the integrity of the insulation. Also, upon the promulgation of more rigorous specifications by which tension and compression characteristics were raised, a different structure—such as one of those described in detail below—was required.

The engineering evaluations further described the advantages of having a continuous wire embedded in the mortar joint of anchored veneer wythes. The seismic aspects of these investigations were reported in the inventor's '319 patent. Besides earthquake protection, the failure of several high-rise buildings to withstand wind and other lateral forces resulted in the incorporation of a continuous wire reinforcement requirement in the Uniform Building Code provisions. The use of a continuous wire in masonry veneer walls has also been found to provide protection against problems arising from thermal expansion and contraction and to improve the uniformity of the distribution of lateral forces in the structure.

Shortly after the introduction of the pronged wall anchor, a seismic veneer anchor, which incorporated an L-shaped backplate, was introduced. This was formed from either 12- or 14-gauge sheetmetal and provided horizontally disposed openings in the arms thereof for pintle legs of the veneer anchor. In general, the pintle-receiving sheetmetal version of the Seismiclip interlock system served well, but in addition to the insulation integrity problem, installations were hampered by mortar buildup interfering with pintle leg insertion.

In the 1980's, an anchor for masonry veneer walls was developed and described in U.S. Pat. No. 4,764,069 by Reinwall et al., which patent is an improvement of the masonry veneer anchor of Lopez, U.S. Pat. No. 4,473,984. Here the anchors are keyed to elements that are installed using power-rotated drivers to deposit a mounting stud in a cementitious or masonry backup wall. Fittings are then attached to the stud which include an elongated eye and a wire tie therethrough for deposition in a bed joint of the outer wythe. It is instructive to note that pin-point loading—that is forces concentrated at substantially a single point—developed from this design configuration. This resulted, upon experiencing lateral forces over time, in the loosening of the stud.

Exemplary of the public sector building specification is that of the Energy Code Requirement, Boston, Mass. (see Chapter 13 of 780 CMR, Seventh Edition). This Code sets forth insulation R-values well in excess of prior editions and evokes an engineering response opting for thicker insulation and correspondingly larger cavities. Here, the emphasis is upon creating a building envelope that is designed and constructed with a continuous air barrier to control air leakage into or out of conditioned space adjacent the inner wythe.

As insulation became thicker, the tearing of insulation during installation of the pronged DW-10X wall anchor, see supra, became more prevalent. This occurred as the installer would fully insert one side of the wall anchor before seating the other side. The tearing would occur at two times, namely, during the arcuate path of the insertion of the second leg and separately upon installation of the attaching hardware. The gapping caused in the insulation permitted air and moisture to infiltrate through the insulation along the pathway formed by the tear. While the gapping was largely resolved by placing a self-sealing, dual-barrier polymeric membrane at the site of the legs and the mounting hardware, with increasing thickness in insulation, this patchwork became less desirable. The improvements hereinbelow in surface mounted wall anchors look toward greater insulation integrity and less reliance on a patch.

Another prior art development occurred shortly after that of Reinwall/Lopez when Hatzinikolas and Pacholok of Fero Holding Ltd. introduced their sheetmetal masonry connector for a cavity wall. This device is described in U.S. Pat. Nos. 5,392,581 and 4,869,043. Here a sheetmetal plate connects to the side of a dry wall column and protrudes through the insulation into the cavity. A wire tie is threaded through a slot in the leading edge of the plate capturing an insulative plate thereunder and extending into a bed joint of the veneer. The underlying sheetmetal plate is highly thermally conductive, and the '581 patent describes lowering the thermal conductivity by foraminously structuring the plate. However, as there is no thermal break, a concomitant loss of the insulative integrity results.

In recent building codes for masonry structures, a trend away from eye and pintle structures is seen in that the newer codes require adjustable anchors be detailed to prevent disengagement. This has led to anchoring systems in which the open end of the veneer tie is embedded in the corresponding bed joint of the veneer and precludes disengagement by vertical displacement.

Another application for high-span anchoring systems is in the evolving technology of self-cooling buildings. Here, the cavity wall serves additionally as a plenum for delivering air from one area to another. While this technology has not seen wide application in the United States, the ability to size cavities to match air moving requirements for naturally ventilated buildings enable the architectural engineer to now consider cavity walls when designing structures in this environmentally favorable form.

In the past, the use of wire formatives have been limited by the mortar layer thicknesses which, in turn are dictated either by the new building specifications or by pre-existing conditions, e.g. matching during renovations or additions the existing mortar layer thickness. While arguments have been made for increasing the number of the fine-wire anchors per unit area of the facing layer, architects and architectural engineers have favored wire formative anchors of sturdier wire. On the other hand, contractors find that heavy wire anchors, with diameters approaching the mortar layer height specification, frequently result in misalignment. This led to the low-profile wall anchors of the inventors hereof as described in U.S. Pat. No. 6,279,283. However, the above-described technology did not address the adaption thereof to surface mounted devices.

In the course of prosecution of U.S. Pat. No. 4,598,518 (Hohmann '518) several patents, indicated by an asterisk on the tabulation below, became known to the inventors hereof and are acknowledged hereby. Thereafter and in preparing for this disclosure, the additional patents which became known to the inventors are discussed further as to the significance thereof:

| Patent | Inventor | O. Cl. | Issue Date |
|---|---|---|---|
| 2,058,148* | Hard | 52/714 | October, 1936 |
| 2,966,705* | Massey | 52/714 | January, 1961 |
| 3,377,764 | Storch | | Apr. 16, 1968 |
| 4,021,990* | Schwalberg | 52/714 | May 10, 1977 |
| 4,305,239* | Geraghty | 52/713 | December, 1981 |
| 4,373,314 | Allan | | Feb. 15, 1983 |
| 4,438,611* | Bryant | 52/410 | March, 1984 |
| 4,473,984 | Lopez | | Oct. 02, 1984 |
| 4,598,518 | Hohmann | | Jul. 08, 1986 |
| 4,869,038 | Catani | | Sep. 26, 1989 |
| 4,875,319 | Hohmann | | Oct. 24, 1989 |
| 5,063,722 | Hohmann | | Nov. 12, 1991 |
| 5,392,581 | Hatzinikolas et al. | | Feb. 28, 1995 |
| 5,408,798 | Hohmann | | Apr. 25, 1995 |
| 5,456,052 | Anderson et al. | | Oct. 10, 1995 |
| 5,816,008 | Hohmann | | Oct. 15, 1998 |
| 6,209,281 | Rice | | Apr. 03, 2001 |
| 6,279,283 | Hohmann et al. | | Aug. 28, 2001 |
| | Foreign Patent Documents | | |
| 279209* | C H | 52/714 | March, 1952 |
| 2069024* | G B | 52/714 | August, 1981 |

Note: Original classification provided for asterisked items only.

It is noted that with some exceptions these devices are generally descriptive of wire-to-wire anchors and wall ties and have various cooperative functional relationships with straight wire runs embedded in the inner and/or outer wythe.

U.S. Pat. No. 3,377,764—D. Storch—Issued Apr. 16, 1968 Discloses a bent wire, tie-type anchor for embedment in a facing exterior wythe engaging with a loop attached to a straight wire run in a backup interior wythe.

U.S. Pat. No. 4,021,990—B. J. Schwalberg—Issued May 10, 1977 Discloses a dry wall construction system for anchoring a facing veneer to wallboard/metal stud construction with a pronged sheetmetal anchor. Like Storch '764, the wall tie is embedded in the exterior wythe and is not attached to a straight wire run.

U.S. Pat. No. 4,373,314—J. A. Allan—Issued Feb. 15, 1983 Discloses a vertical angle iron with one leg adapted for attachment to a stud; and the other having elongated slots to accommodate wall ties. Insulation is applied between projecting vertical legs of adjacent angle irons with slots being spaced away from the stud to avoid the insulation.

U.S. Pat. No. 4,473,984—Lopez—Issued Oct. 2, 1984 Discloses a curtain-wall masonry anchor system wherein a wall tie is attached to the inner wythe by a self-tapping screw to a metal stud and to the outer wythe by embedment in a corresponding bed joint. The stud is applied through a hole cut into the insulation.

U.S. Pat. No. 4,869,038—M. J. Catani—Issued 091/26/89 Discloses a veneer wall anchor system having in the interior wythe a truss-type anchor, similar to Hala et al. '226, supra, but with horizontal sheetmetal extensions. The extensions are interlocked with bent wire pintle-type wall ties that are embedded within the exterior wythe.

U.S. Pat. No. 4,879,319—R. Hohmann—Issued Oct. 24, 1989 Discloses a seismic construction system for anchoring a facing veneer to wallboard/metal stud construction with a pronged sheetmetal anchor. Wall tie is distinguished over that of Schwalberg '990 and is clipped onto a straight wire run.

U.S. Pat. No. 5,392,581—Hatzinikolas et al.—Issued Feb. 28, 1995 Discloses a cavity-wall anchor having a conventional tie wire for mounting in the brick veneer and an L-shaped sheetmetal bracket for mounting vertically between side-by-side blocks and horizontally on atop a course of blocks. The bracket has a slit which is vertically disposed and protrudes into the cavity. The slit provides for a vertically adjustable anchor.

U.S. Pat. No. 5,408,798—Hohmann—Issued Apr. 25, 1995 Discloses a seismic construction system for a cavity wall having a masonry anchor, a wall tie, and a facing anchor. Sealed eye wires extend into the cavity and wire wall ties are threaded therethrough with the open ends thereof embedded with a Hohmann '319 (see supra) clip in the mortar layer of the brick veneer.

U.S. Pat. No. 5,456,052—Anderson et al.—Issued Oct. 10, 1995 Discloses a two-part masonry brick tie, the first part being designed to be installed in the inner wythe and then, later when the brick veneer is erected to be interconnected by the second part. Both parts are constructed from sheetmetal and are arranged on substantially the same horizontal plane.

U.S. Pat. No. 5,816,008—Hohmann—Issued Oct. 15, 1998 Discloses a brick veneer anchor primarily for use with a cavity wall with a drywall inner wythe. The device combines an L-shaped plate for mounting on the metal stud of the drywall and extending into the cavity with a T-head bent stay. After interengagement with the L-shaped plate the free end of the bent stay is embedded in the corresponding bed joint of the veneer.

U.S. Pat. No. 6,209,281—Rice—Issued Apr. 3, 2001 Discloses a masonry anchor having a conventional tie wire for mounting in the brick veneer and sheetmetal bracket for mounting on the metal-stud-supported drywall. The bracket has a slit which is vertically disposed when the bracket is mounted on the metal stud and, in application, protrudes through the drywall into the cavity. The slit provides for a vertically adjustable anchor.

U.S. Pat. No. 6,279,283—Hohmann et al.—Issued Aug. 28, 2001 Discloses a low-profile wall tie primarily for use in renovation construction where in order to match existing mortar height in the facing wythe a compressed wall tie is embedded in the bed joint of the brick veneer.

None of the above provide the high-strength, surface-mounted wall anchor or anchoring systems utilizing these devices of this invention. As will become clear in reviewing the disclosure which follows, the cavity wall structures benefit from the recent developments described herein that lead to solving the problems of insulation integrity, of interference from excess mortar, and of high-strength applications. In the related Application, folded wall anchors are structured with legs that are mounted inboard to the baseplate thereby enabling the baseplate to cover the insertion openings. Here, further improvements in surface-mounted anchors and systems including surface-mounted anchors are introduced.

SUMMARY

In general terms, the invention disclosed hereby is a unique surface mounted wall anchor and an anchoring system employing the same. The wall anchor is a sheetmetal device which is described herein as functioning with various wire formative veneer ties. In two embodiments, enfolded legs have a projecting portion and a nonprojecting portion. The folded construction of the wall tie enables the junctures of the legs and the base of the wall anchor to be located inboard from the periphery of the wall anchor. During formation of the wall anchor, the outer surface of the nonprojecting portion of the enfolded leg and the underside of the base are caused to be coplanar. Upon installation, the coplanar elements act to seal the insertion point where the legs enter into the exterior layer of building materials on the inner wythe. This sealing effect precludes the penetration of air, moisture, and water vapor into the inner wythe structure. In all of the embodiments shown, the legs are formed to fully or partially sheath the mounting hardware of the wall anchor. The sheathing function reduces the openings in the insulation required for installing the wall anchor.

In the first embodiment, the folded wall anchor is adapted from the earlier inventions of Schwalberg, U.S. Pat. No. 4,021,990 and of Hohmann, U.S. Pat. No. 4,875,319, see supra. Here it is seen that the double folded wall anchor (with legs moved inboard) have deeply impressed ribs alongside the bail, which creates a wall anchor construct of superior strength. This construct is applied to an insulated dry wall inner wythe having insulation over wallboard cavity, and an outer wythe of brick. The channel in the projecting portion of the legs ensheaths the exterior side of the mounting hardware.

In the second embodiment, the inboard legs are of a tubular form, constructed to pierce the insulation and wallboard portions of an insulated dry wall inner wythe having insulation over a wallboard cavity, and to guide mounting hardware consisting of a threaded fastener to mechanically engage the structural frame supporting the wallboard.

In the third embodiment, the folded wall anchor is of the winged variety. The wings in this embodiment are slotted and permit continuously adjustable positioning of the veneer tie. Here it is seen that a double folded wall anchor together with a box veneer tie is applied to a dry wall inner wythe having interior insulation and, thus, the wall anchor legs have only to penetrate the wallboard layer. In the third embodiment, the wings are slotted with a centrally disposed reinforcement bar. The folded wall anchor is paired with a canted, low-profile veneer anchor. The folded wall anchor is surface-mounted to a masonry block inner wythe having insulation on the exterior surface and a brick facing. The use of this innovative surface-mounted wall anchor in various applications addresses the problems of insulation integrity, thermal conductivity, and pin-point loading encountered in the previously discussed inventions.

OBJECTS AND FEATURES OF THE INVENTION

Accordingly, it is the primary object of the present invention to provide a new and novel anchoring systems for cavity walls, which systems are surface mountable to the backup wythe thereof.

It is another object of the present invention to provide a new and novel wall anchor mounted on the exterior surface of the wallboard or the insulation layer and secured to the metal stud or standard framing member of a dry wall construction.

It is yet another object of the present invention to provide an anchoring system which is resistive to high levels of tension and compression and, further, is detailed to prevent disengagement under seismic or other severe environmental conditions.

It is still yet another object of the present invention to provide an anchoring system which is constructed to maintain insulation integrity by preventing air and water penetration thereinto.

It is a feature of the present invention that the wall anchor hereof requires fewer openings in the insulation for installation and has a coplanar baseplate for sealing against the insertion points in the insulation.

It is another feature of the present invention that the legs of the wall anchor hereof have only point contact with the metal studs with substantially no resultant thermal conductivity.

It is yet another feature of the present invention that the bearing area between the wall anchor and the veneer tie spreads the forces thereacross and avoids pin-point loading.

Other objects and features of the invention will become apparent upon review of the drawing and the detailed description which follows.

BRIEF DESCRIPTION OF THE DRAWING

In the following drawing, the same parts in the various views are afforded the same reference designators.

DESCRIPTION OF THE PREFERRED EMBODIMENTS

Figure 1:
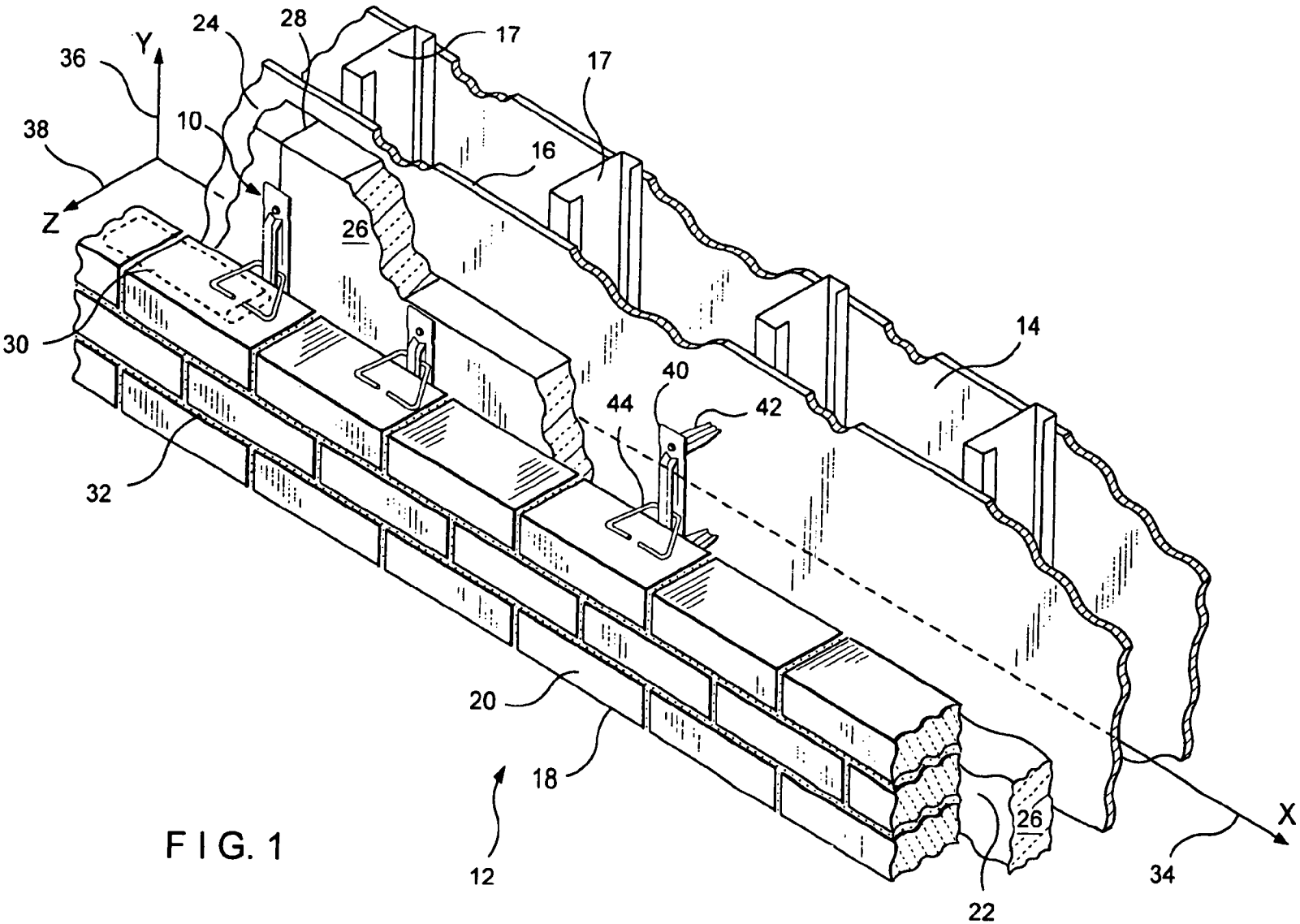
FIG. 1 shows a first embodiment of this invention and is a perspective view of a surface-mounted anchoring system as applied to a cavity wall with an inner wythe of dry wall construction having insulation disposed on the cavity-side thereof and an outer wythe of brick.

Before entering into the detailed Description of the Preferred Embodiments, several terms which will be revisited later are defined. These terms are relevant to discussions of innovations introduced by the improvements of this disclosure that overcome the technical shortcoming of the prior art devices.

In the embodiments described hereinbelow, the inner wythe is provided with insulation. In the dry wall construction, this takes the form, in the first and second embodiments of exterior insulation disposed on the outer surface of the inner wythe. In the third embodiment, a masonry block backup wall construction is shown having insulation applied to the outer surface of the masonry block. Recently, building codes have required that after the anchoring system is installed and, prior to the inner wythe being closed up, that an inspection be made for insulation integrity to ensure that the insulation prevents infiltration of air and moisture. Here the term insulation integrity is used in the same sense as the building code in that, after the installation of the anchoring system, there is no change or interference with the insulative properties and concomitantly substantially no change in the air and moisture infiltration characteristics. It is noted that in contradistinction to the related application cited hereinabove, these high-strength wall anchors are designed to be less invasive into the insulation.

In a related sense, prior art sheetmetal anchors have formed a conductive bridge between the wall cavity and the metal studs of columns of the interior of the building. Here the terms thermal conductivity and thermal conductivity analysis are used to examine this phenomenon and the metal-to-metal contacts across the inner wythe.

The term inboard leg as used hereinafter refers to a metal leg joined to a planar metal base, where the base is positioned substantially at right angles (normal) to the longitudinal axis of the leg and where at the planar location that the leg joins to the base, the base surrounds the latitudinal (cross-sectional) perimeter of the leg with some area of base material extending on all sides of this joint. The base has two major faces, identified by the orientation presented when the veneer anchor is installed. The face oriented towards the inner wythe is identified as the base surface or mounting surface, and the face oriented towards the outer wythe is the outer surface. The preferred embodiment of the inboard leg extends outwards from the mounting surface of the veneer anchor.

Anchoring systems for cavity walls are used to secure veneer facings to a building and overcome tension and compression from seismic and other forces, i.e. wind shear, etc. In the past, some systems have experienced failure because the forces have been concentrated at substantially a single point. Here, the term pinpoint loading refers to an anchoring system wherein forces are concentrated at a single point.

In addition to that which occurs at the facing wythe, attention is further drawn to the construction at the exterior surface of the inner or backup wythe. Here there are two concerns. namely, maximizing the strength of the securement of the surface-mounted wall anchor to the backup wall and, as previously discussed minimizing the interference of the anchoring system with the insulation. The first concern is addressed using appropriate fasteners such as, for mounting to masonry block, the properly sized concrete threaded anchors with expansion sleeves or concrete expansion bolts and, for mounting to metal, dry-wall studs, self-tapping screws. The latter concern is addressed by the flatness of the base of the surface-mounted, folded anchors covering the openings formed by the legs (the profile is seen in the cross-sectional drawings of FIGS. 3 and 7).

In the detailed description, the veneer reinforcements and the veneer anchors are wire formatives. The wire used in the fabrication of veneer joint reinforcement conforms to the requirements of ASTM Standard Specification A951-00, Table 1. For the purpose of this application tensile strength tests and yield tests of veneer joint reinforcements are, where applicable, those denominated in ASTM A-951-00 Standard Specification for Masonry Joint Reinforcement.

Referring now to FIGS. 1 through 4, the first embodiment shows an anchoring system with a high-strength, surface-mounted wall anchor. This system is suitable for recently promulgated standards with more rigorous tension and compression characteristics. The system discussed in detail hereinbelow, has a high-strength, folded wall anchor and an interengaging veneer tie. The wall anchor is surface mounted onto an externally insulated dry wall. For the first embodiment, a cavity wall having an insulative layer of 2.5 inches (approx.) and a total span of 3.5 inches (approx.) is chosen as exemplary.

The surface-mounted anchoring system for cavity walls is referred to generally by the numeral 10. A cavity wall structure 12 is shown having an inner wythe or dry wall backup 14 with sheetrock or wallboard 16 mounted on metal studs or columns 17 and an outer wythe or facing wall 18 of brick 20 construction. Between the inner wythe 14 and the outer wythe 18, a cavity 22 is formed. The cavity 22, which has a 3.5-inch span, has attached to the exterior surface 24 of the inner wythe 14 insulation in the form of insulating panels 26. The insulation 26 is disposed on wallboard 16. Seams 28 between adjacent panels of insulation 26 are shown as being substantially vertical and each in alignment with the center of a column 17; however, horizontal insulating panels may also be used with the anchoring system described herein.

Successive bed joints 30 and 32 are substantially planar and horizontally disposed and in accord with building standards are 0.375-inch (approx.) in height. Selective ones of bed joints 30 and 32, which are formed between courses of bricks 20, are constructed to receive therewithin the insertion portion of the anchoring system hereof. Being surface mounted onto the inner wythe, the anchoring system 10 is constructed cooperatively therewith and is configured to minimize air and moisture penetration around the wall anchor/inner wythe juncture.

For purposes of discussion, the cavity surface 24 of the inner wythe 14 contains a horizontal line or x-axis 34 and an intersecting vertical line or y-axis 36. A horizontal line or z-axis 38, normal to the xy-plane, passes through the coordinate origin formed by the intersecting x- and y-axes. A folded wall anchor 40 is shown which has a pair of legs 42 which penetrate the wallboard 16 and insulation 26. Folded wall anchor 40 is a stamped metal construct which is constructed for surface mounting on inner wythe 14 and for interconnection with veneer tie 44.

The veneer tie 44 is a wire formative of a gage close to the receptor opening measured in an xz plane. The veneer tie 44 is shown in FIG. 1 as being emplaced on a course of bricks 20 in preparation for embedment in the mortar of bed joint 30. In this embodiment, the system includes a wall anchor 40 and a veneer tie 44.

Figure 2:
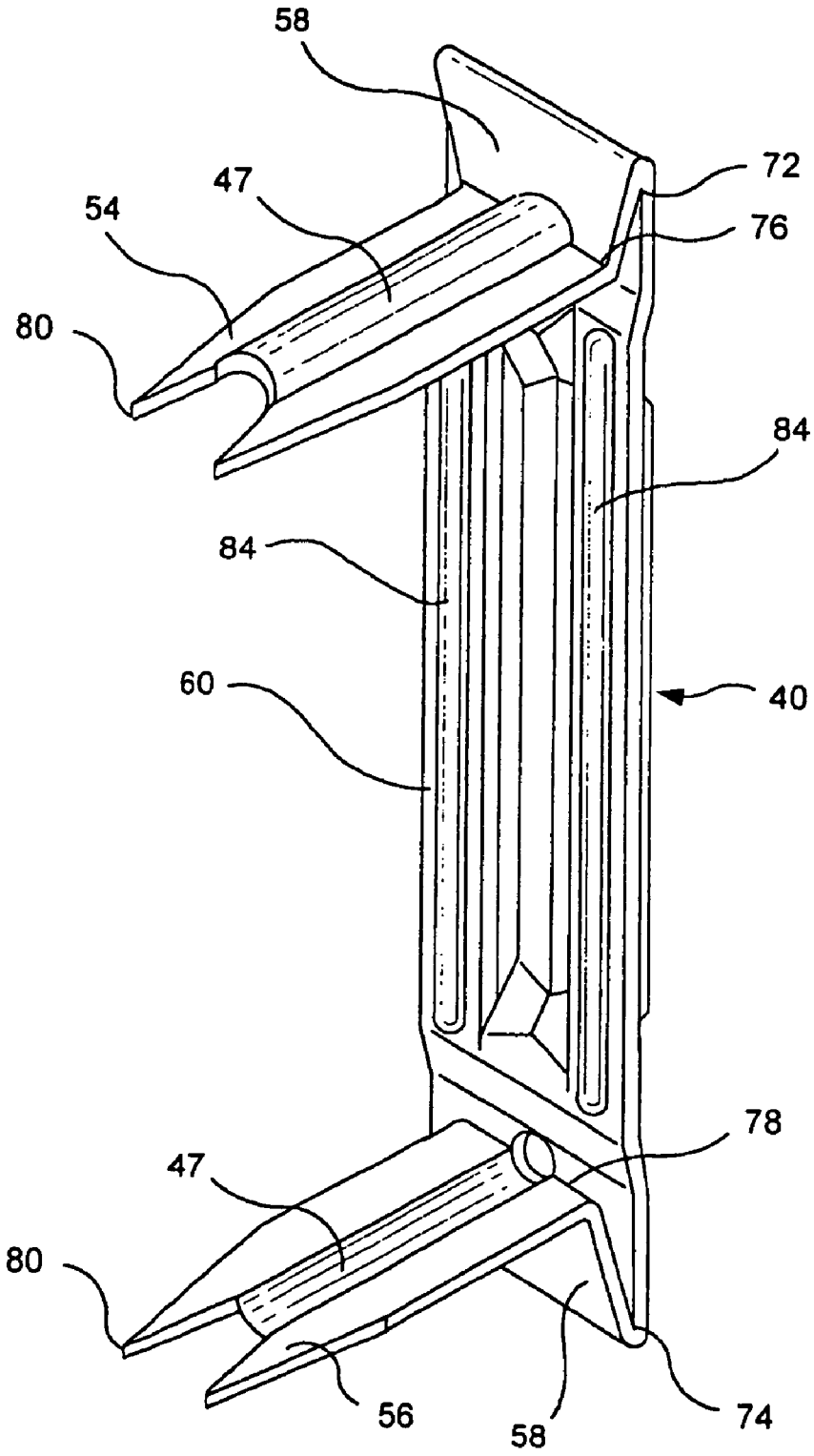
FIG. 2 is a rear perspective view showing the folded wall anchor of the surface-mounted anchoring system of FIG. 1 for ensheathing the exterior of the mounting hardware.

At intervals along a horizontal line on surface 24, the folded wall anchors 40 are surface-mounted. In this structure, channels 47 sheathe the exterior of mounting hardware 48. The folded wall anchors 40 are positioned on surface 24 50 that the longitudinal axis of a column 17 lies within the yz-plane formed by the longitudinal axes 50 and 52 of upper leg 54 and lower leg 56, respectively. The legs 54 and 56 are folded and swaged, as best shown in FIG. 2, so that the base surface 58 of the leg portions and the base surface 60 of the bail portion 62 are substantially coplanar and, when installed, lie in an xy-plane. A typical series of metalworking steps to produce the finished inboard lens 54 and 56 would include stamping of the basic flat shape. swaging the channels 47, folding the 90° bend between the legs 54 and 56 and the leg bases 58. folding the 180° bend between the leg bases 58 and the base surface 60, and swaging the leg bases 58 and base surface 60 into a substantially coplanar form. Upon insertion in insulation 26, the leg bases 58 and base surface 60 rest snugly against the opening formed thereby and serves to cover the opening precluding the passage of air and moisture therethrough. This construct maintains the insulation integrity.

The dimensional relationship between wall anchor 40 and veneer tie 44 limits the axial movement of the construct. Each veneer tie 44 has front legs 68 and 70 and a rear leg 64 opposite the bed-joint-deposited portion thereof which is formed continuous therewith. The slot or bail aperture 66 of bail 62 is constructed, in accordance with the building code requirements, to be within the predetermined dimensions to limit the z-axis 38 movement. The slot 66 is slightly larger horizontally than the diameter of the tie. The receptor opening or bail slot 66 is elongated vertically to accept a veneer tie threadedly therethrough and permit y-axis adjustment. The dimensional relationship of the rear leg 64 to the width of bail 62 limits the x-axis movement of the construct.

Figure 3:
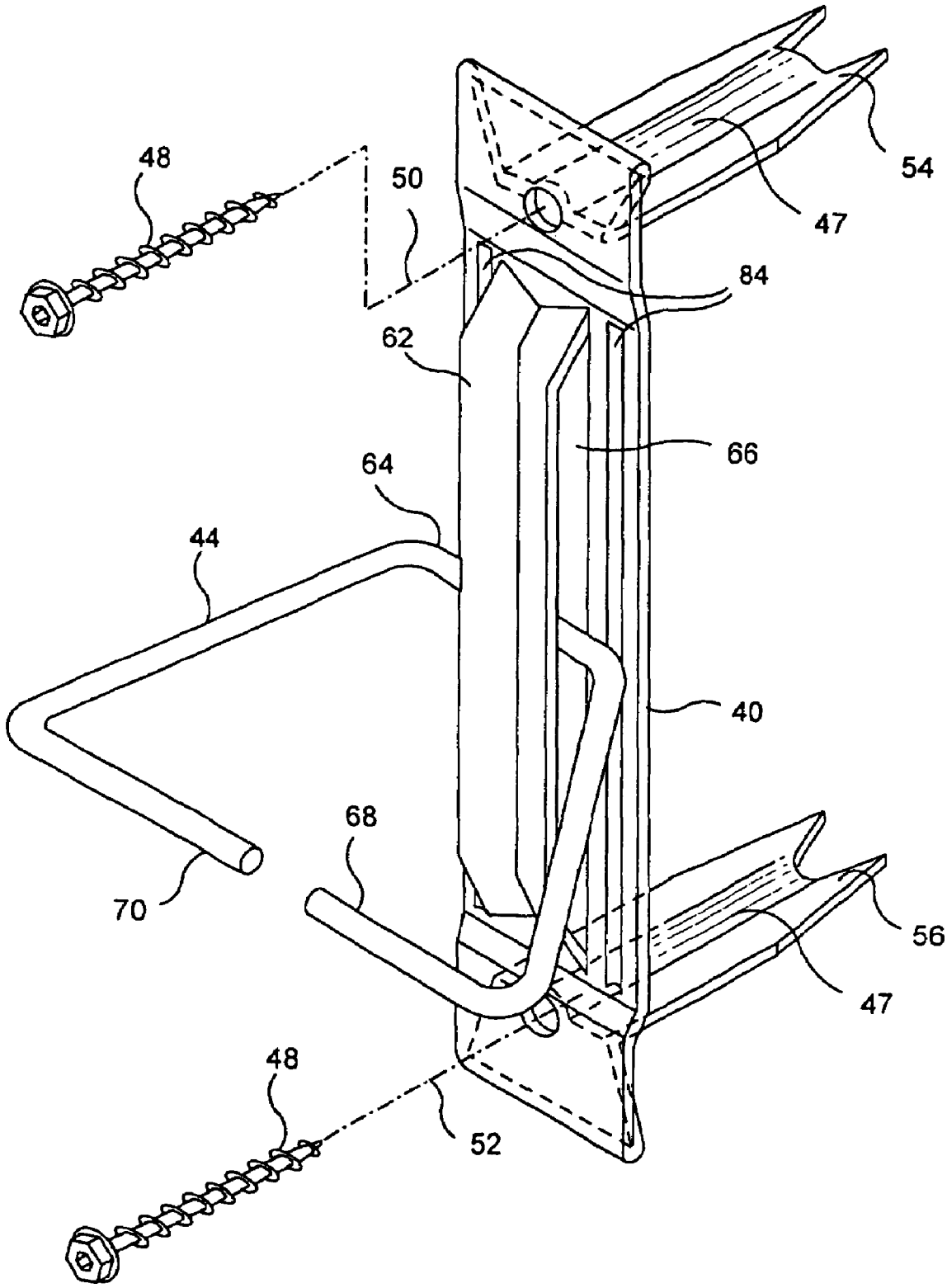
FIG. 3 is a perspective view of the surface-mounted anchoring system of FIG. 1 shown with a folded wall anchor and a veneer tie threaded therethrough.
Figure 4:
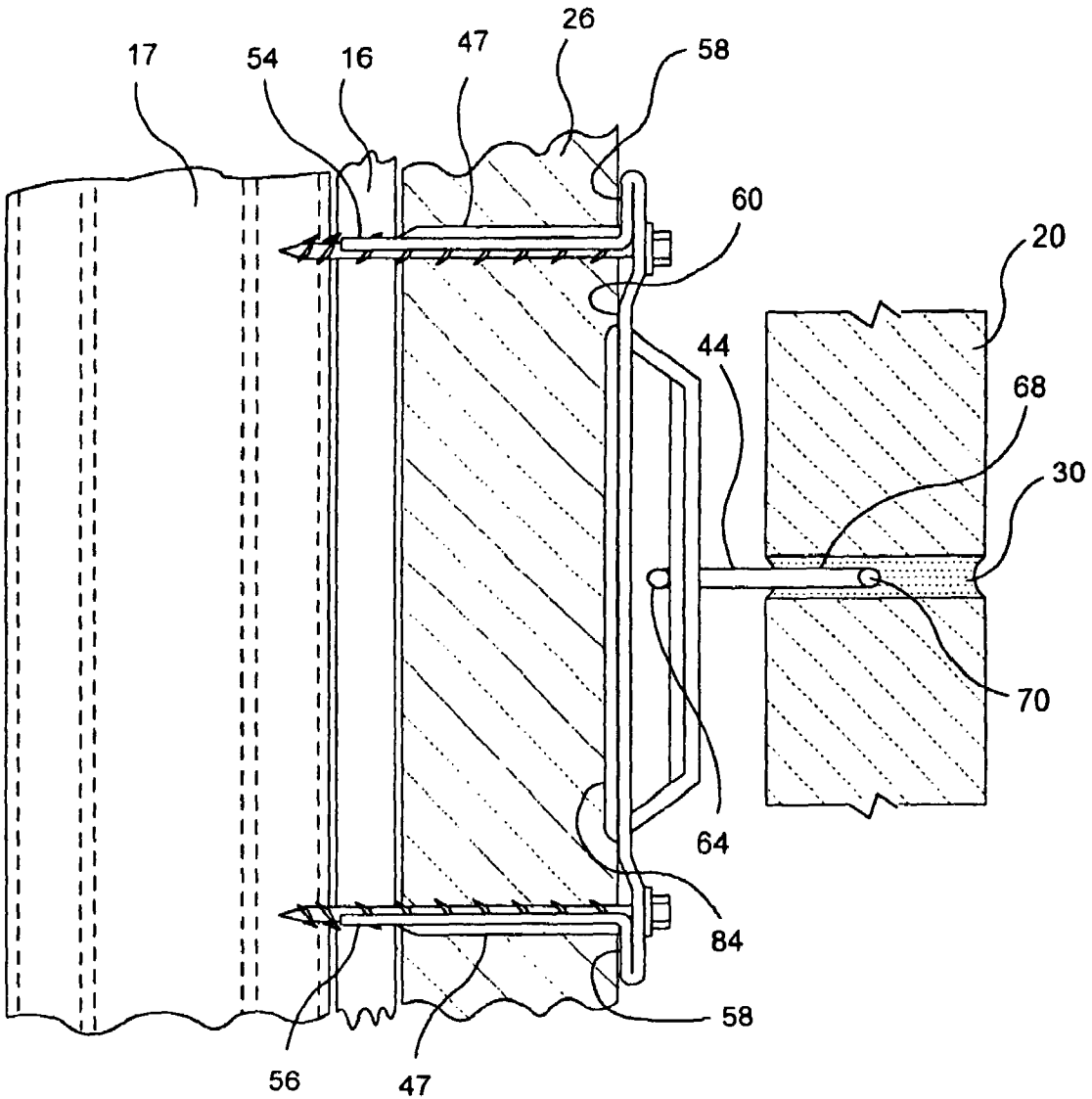
FIG. 4 is a cross sectional view of FIG. 1 which shows the relationship of the surface-mounted anchoring system of this invention to the dry wall construction and to the brick outer wythe.

The folded wall anchor 40 is seen in more detail in FIGS. 2 through 4. The legs 54 and 56 are folded 180° about end seams 72 and 74, respectively, and then 90° at the inboard seams 76 and 78, respectively, so as to extend parallel the one to the other. The legs 54 and 56 are dimensioned so that, upon installation, they extend through insulation panels 26 and wallboard 16 and the endpoints 80 thereof abut the metal studs 17. Although only two-leg structures are shown, it is within the contemplation of this invention that more folded legs could be constructed with each leg terminating at an inboard seam and having the insertion point 82 of the insulation 26 covered by the wall anchor body. Because the legs 54 and 56 abut the studs 17 only at endpoints 80, the thermal conductivity across the construct is minimal as the cross sectional metal-to-metal contact area is minimized. (There is virtually no heat transfer across the mounting hardware 48 because of the isolating, nonconductive washers thereof.)

In this embodiment, as best seen in FIGS. 3 and 4, strengthening ribs 84 are impressed in the base surface 60 of wall anchor 40. The ribs 84 are substantially parallel to the bail opening 66 and, when mounting hardware 48 is fully seated so that the base surface 60 rests against the face of insulation 26, the ribs 84 are then pressed into the surface of the insulation 26. This provides additional sealing. While the ribs 84 are shown as protruding toward the insulation, it is within the contemplation of this invention that ribs 84 could be raised in the opposite direction. The alternative structure would be used in applications wherein the outer layer of the inner wythe is noncompressible and does not conform to the rib contour. The ribs 84 strengthen the wall anchor 40 and achieves an anchor with a tension and compression rating of 100 lbf.

Figure 5:
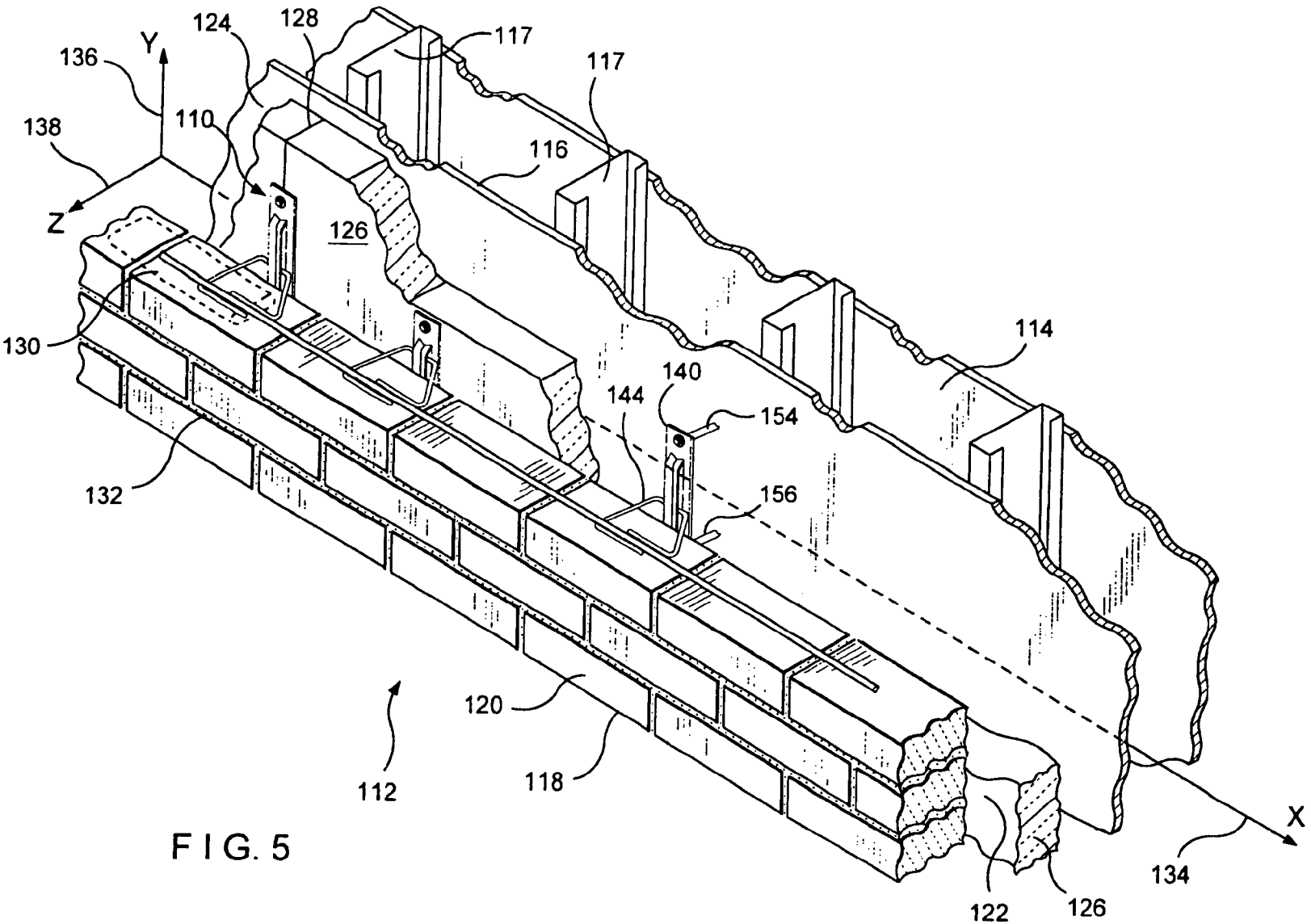
FIG. 5 is a perspective view of a second embodiment of this invention showing a surface-mounted anchoring system for a seismic-resistant cavity wall and is similar to FIG. 1, but shows wall anchors with tubular legs and a swaged veneer tie accommodating a reinforcing bar in the bed joints of the brick outer wythe.
Figure 6:
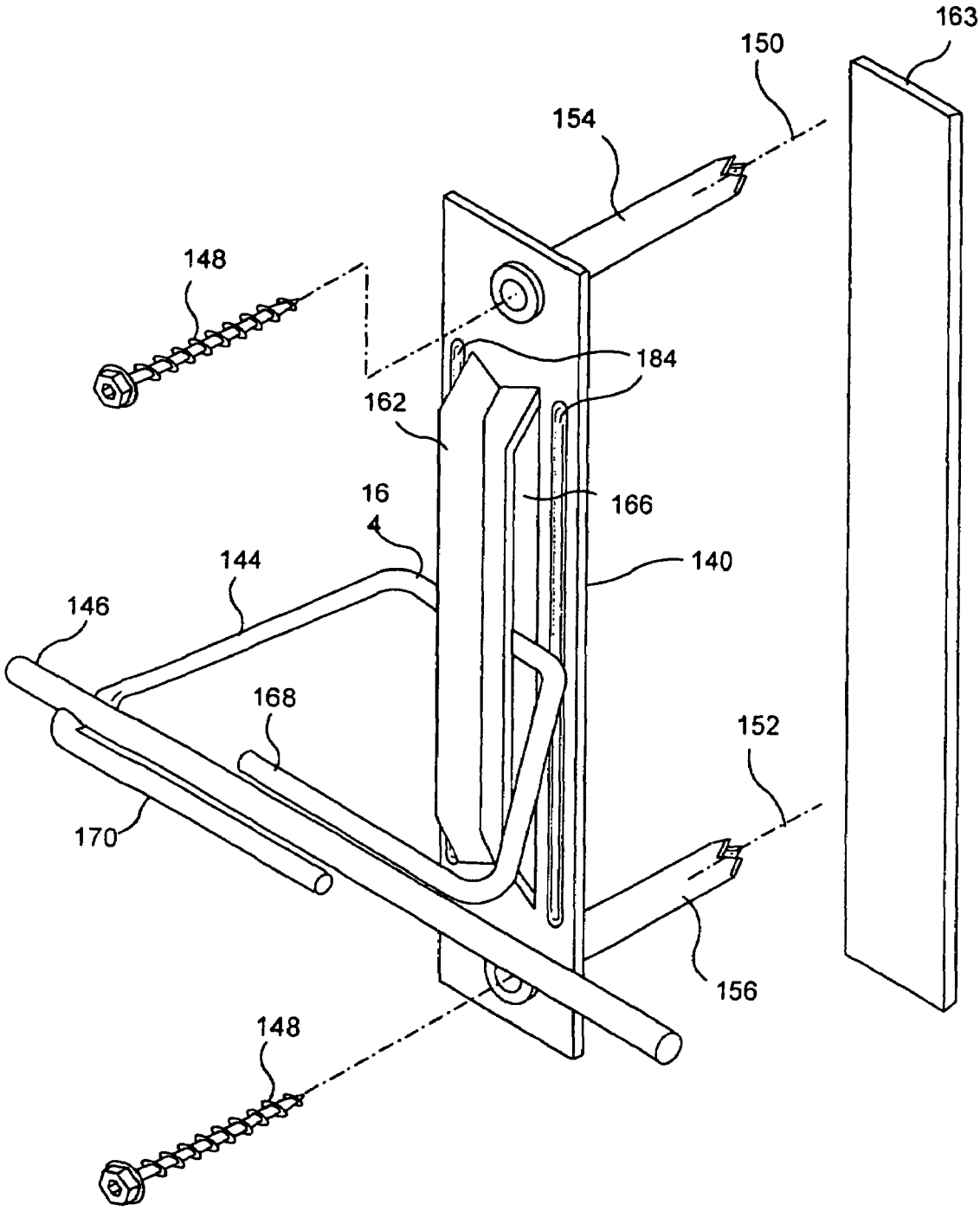
FIG. 6 is a rear perspective view showing the surface-mounted anchoring system having a wall anchor with tubular legs of FIG. 5.
Figure 7:
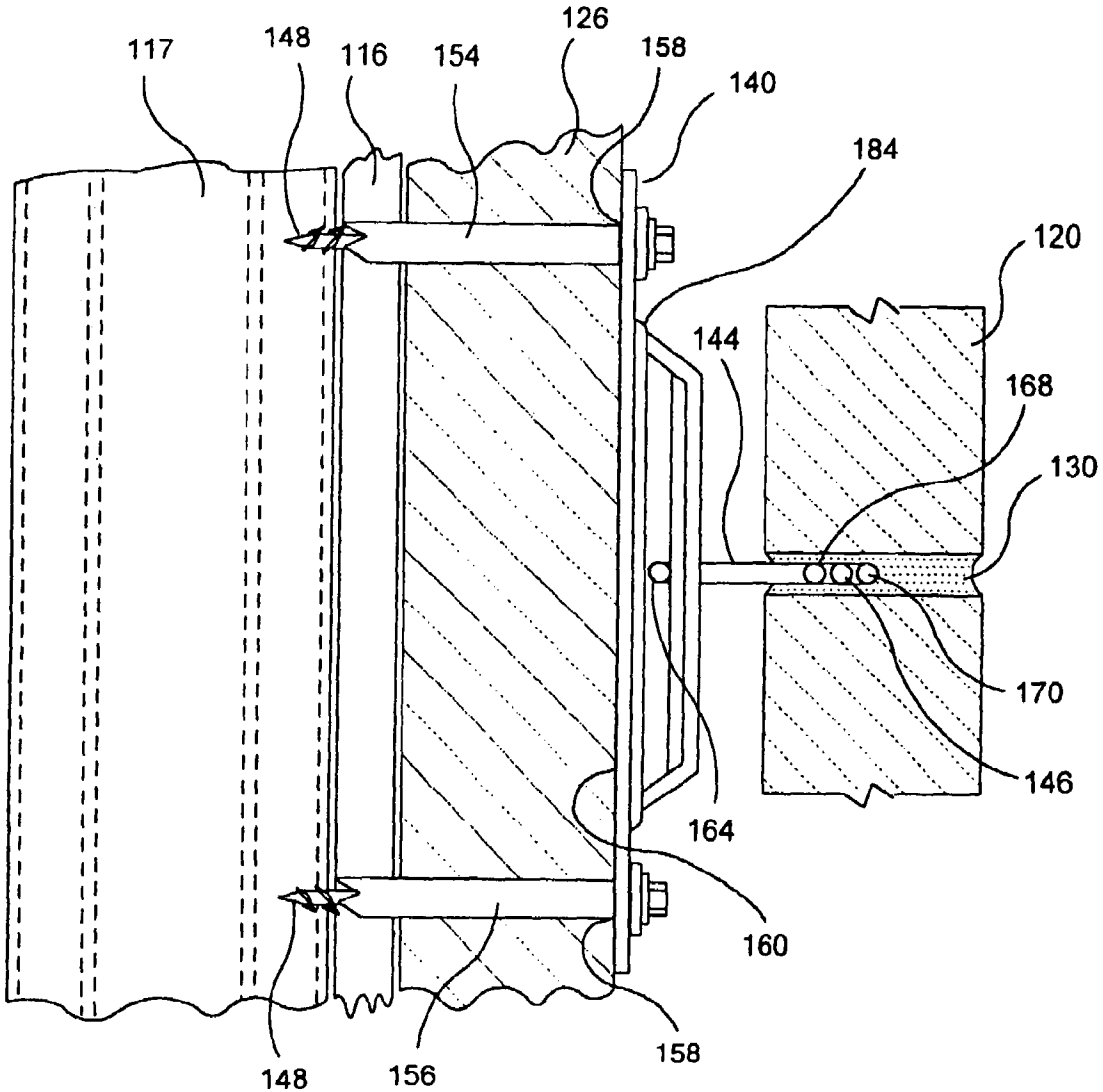
FIG. 7 is a cross sectional view of FIG. 5 which shows the relationship of the surface-mounted wall anchor with tubular legs and the corresponding swaged veneer tie and reinforcing bar.

The description which follows is a second embodiment of the surface-mounted anchoring system for cavity walls of this invention. For ease of comprehension, wherever possible similar parts use reference designators 100 units higher than those above. Thus, the veneer tie 144 of the second embodiment is analogous to the veneer tie 44 of the first embodiment. Referring now to FIGS. 5 through 7, the second embodiment of the surface-mounted anchoring system is shown and is referred to generally by the numeral 110. As in the first embodiment, a wall structure 112 is shown. The second embodiment has an inner wythe or backup wall 114 of a dry wall or a wallboard construct 116 on columns or studs 117 and an outer wythe or veneer 118 of facing brick 120. The inner wythe 114 and the outer wythe 118 have a cavity 122 therebetween. Here, the anchoring system has a surface-mounted wall anchor with tubular legs and a swaged veneer tie for receiving reinforcement bars to create a seismic anchoring system.

The anchoring system 110 is surface mounted to the exterior surface 124 of the inner wythe 114. In this embodiment like the previous one, panels of insulation 126 are disposed on wallboard 116 and, in turn, on columns 117. Successive bed joints 130 and 132 are substantially planar and horizontally disposed and in accord with building standards are 0.375-inch (approx.) in height. Selective ones of bed joints 130 and 132, which are formed between courses of bricks 120, are constructed to receive therewithin the insertion portion of the anchoring system construct hereof. Being surface mounted onto the inner wythe, the anchoring system 110 is constructed cooperatively therewith, and as described in greater detail below, is configured to penetrate through the wallboard at a covered insertion point.

For purposes of discussion, the cavity surface 124 of the inner wythe 114 contains a horizontal line or x-axis 134 and an intersecting vertical line or y-axis 136. A horizontal line or z-axis 138, normal to the xy-plane, passes through the coordinate origin formed by the intersecting x- and y-axes. A wall anchor 140 is shown which has a pair of tubular legs 142 which penetrate the insulation 126 and the wallboard 116. Wall anchor 140 is a stamped metal construct which is constructed for surface mounting on inner wythe 114 and for interconnection with veneer tie 144 which, in turn, receives reinforcement 146 therewithin.

The veneer tie 144 is a swaged Byna-Tie® device manufactured by Hohmann & Barnard, Inc., Hauppauge, N.Y. 11788. The veneer tie 144 is shown in FIG. 5 as being emplaced on a course of bricks 120 in preparation for embedment in the mortar of bed joint 130. In this embodiment, the system includes a wall anchor 140, veneer reinforcement 146, and a swaged veneer tie 144. The veneer reinforcement 146 is constructed of a wire formative conforming to the joint reinforcement requirements of ASTM Standard Specification A951-00, Table 1, see supra.

At intervals along a horizontal line on surface 124, wall anchors 140 are surface-mounted. In this structure, tubular legs 154 and 156 sheathe the mounting hardware 148. The hardware is adapted to thermally isolate the wall anchor 140 with the neoprene sealing washers thereof. The wall anchors 140 are positioned on surface 124 so that the longitudinal axis of a column 117 lies within the yz-plane formed by the longitudinal axes 150 and 152 of upper tubular leg 154 and lower tubular leg 156, respectively. As best shown in FIGS. 6 and 7, tubular legs 154 and 156 are at their bases 158 inboard within the base surface 160 and along the longitudinal axis of the tubular legs are substantially normal to the base surface 160. The base surface 160 when installed, lies in an xy-plane. Upon insertion in the wallboard 116 the tubular leg bases 158 and the base surface 160 rest snugly against the opening formed thereby and serves to cover the opening precluding the passage of air and moisture therethrough, thereby maintaining the insulation integrity. It is within the contemplation of this invention that a coating of sealant or a layer of a polymeric compound - such as a closed-cell foam - be placed on base surfaces 158 and 160 for additional sealing. Because of the sheathing of the mounting hardware 148 within channels 47, only two openings are required in insulation 26 for each wall anchor 40. Optionally, a layer of Textroseal® sealant 163, a thick multiply polyethylene/polymer-modified asphalt distributed by Hohmann & Barnard, Inc., Hauppauge, NY 11788 may be applied under the tubular leg bases 158 and the base surface 160 for additional protection.

In this embodiment, as best seen in FIGS. 6 and 7, strengthening ribs 184 are impressed in the base surface 160 of wall anchor 140. The ribs 184 are substantially parallel to the bail opening 166 and, when mounting hardware 148 is fully seated so that the base surface 160 rests against the face of insulation 126, the ribs 184 are then raised from the surface of the insulation 126. Thus, the ribs 184 are shown as protruding away the insulation, in a manner opposite that of the first embodiment. This alternative structure is particularly applicable where the outer layer of the inner wythe is noncompressible and does not conform to the rib contour. The ribs 184 strengthen the wall anchor 140 and achieves an anchor with a tension and compression rating of 100 lbf.

Figure 8:
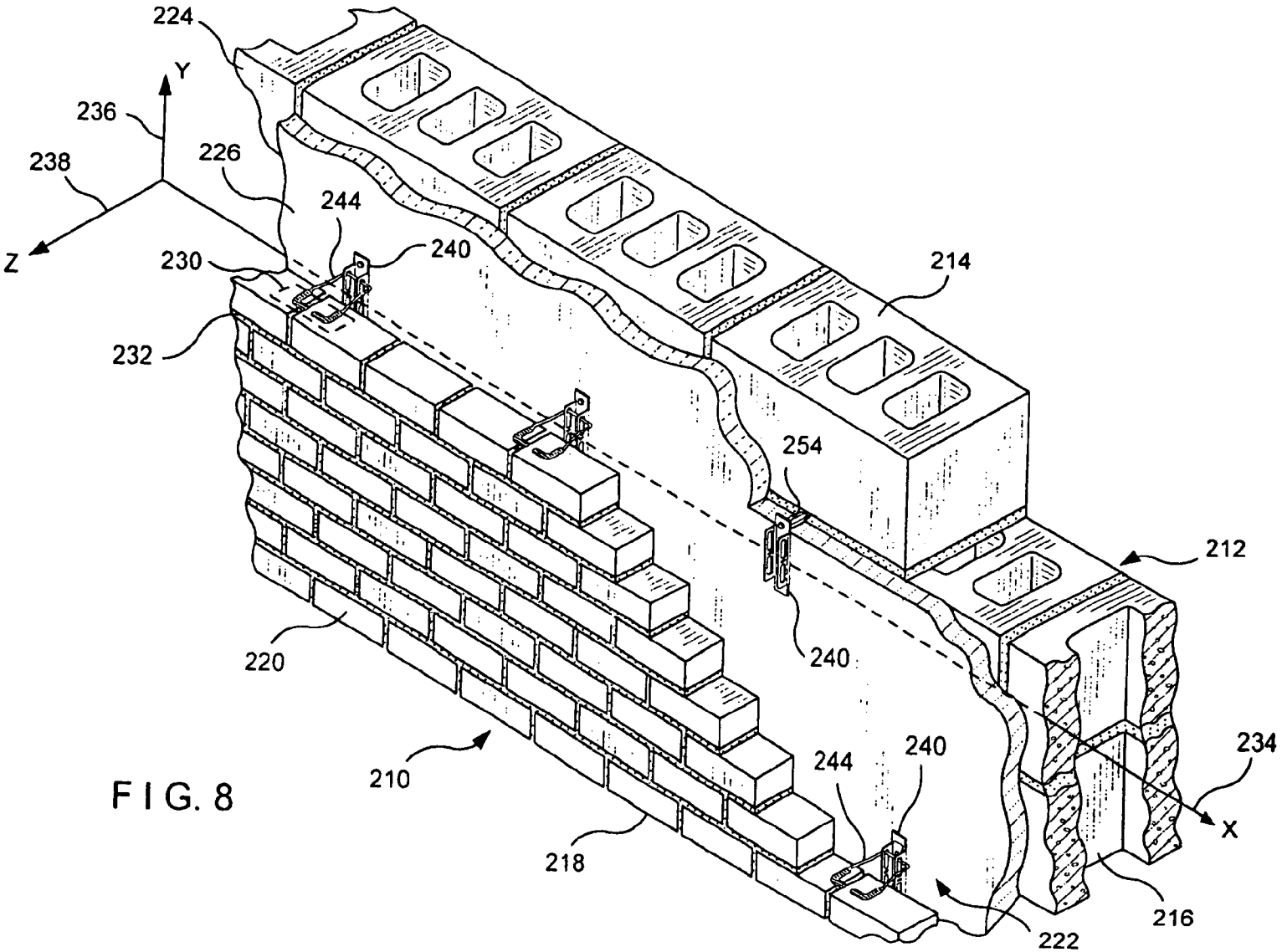
FIG. 8 is a perspective view of a third embodiment of this invention showing a surface-mounted anchoring system for a cavity wall and is similar to FIG. 1, but shows a masonry block backup wall with a high-strength, folded wall anchor with slotted wings and a low-profile, canted veneer tie.
Figure 10:
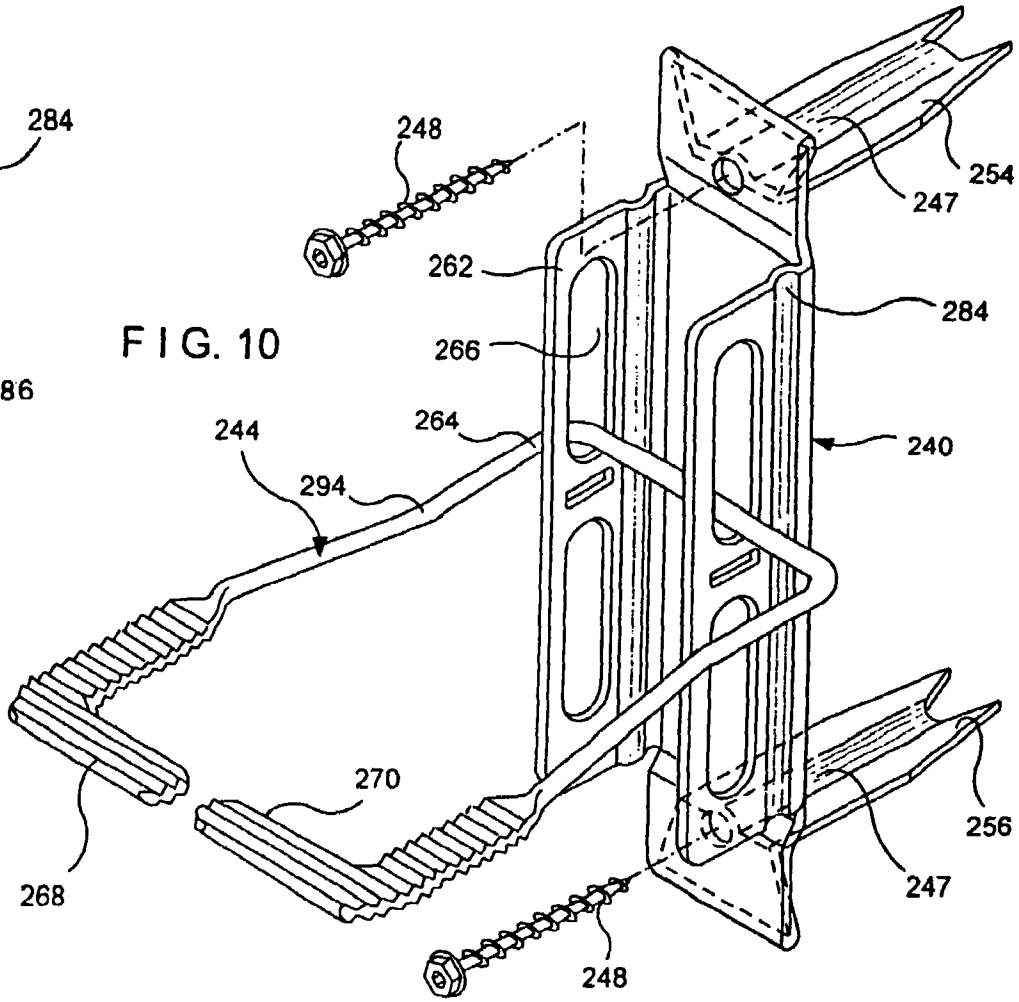
Figure 9:
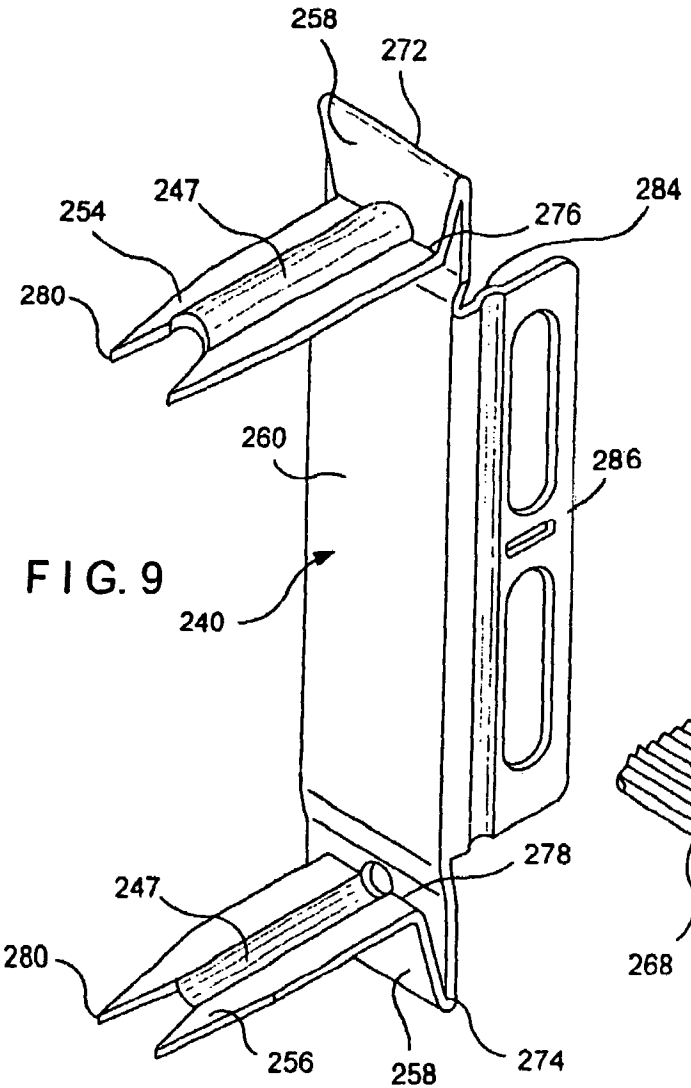
FIG. 9 is a rear perspective view showing the wall anchor with ribbed slotted wings of FIG. 8 having channels for ensheathing the interior of the mounting hardware; and, FIG. 10 is a partial perspective view of FIG. 8 showing the relationship of the wall anchor and the corresponding veneer tie.

The description which follows is a third embodiment of the surface-mounted anchoring system for cavity walls of this invention. For ease of comprehension, wherever possible similar parts use reference designators 100 units higher than those above. Thus, the veneer tie 244 of the third embodiment is analogous to the veneer tie 144 of the second embodiment. Referring now to FIGS. 8 through 10, the third embodiment of the surface-mounted anchoring system is shown and is referred to generally by the numeral 210. As in the previous embodiments, a wall structure 212 is shown. Here, the third embodiment has an inner wythe or backup wall 214 of masonry block 216 and an outer wythe or veneer 218 of facing brick 220. The inner wythe 214 and the outer wythe 218 have a cavity 222 therebetween. The anchoring system has a surface-mounted wall anchor with slotted wing portions or receptors for receiving the veneer tie portion of the anchoring system and a low-profile box tie.

The anchoring system 210 is surface mounted to the exterior surface 224 of the inner wythe 214. In this embodiment panels of insulation 226 are disposed on the masonry block 216. Successive bed joints 230 and 232 are substantially planar and horizontally disposed and in accord with building standards are 0.375-inch (approx.) in height. Selective ones of bed joints 230 and 232, which are formed between courses of bricks 220, are constructed to receive therewithin the insertion portion of the anchoring system construct hereof. Being surface mounted onto the inner wythe, the anchoring system 210 is constructed cooperatively therewith, and as described in greater detail below, is configured to penetrate through the insulation at a covered insertion point.

For purposes of discussion, the cavity surface 224 of the inner wythe 214 contains a horizontal line or x-axis 234 and an intersecting vertical line or y-axis 236. A horizontal line or z-axis 238, normal to the xy-plane, passes through the coordinate origin formed by the intersecting x- and y-axes. A folded wall anchor 240 is shown which has a pair of legs 242 which penetrate the insulation 226. Folded wall anchor 240 is a stamped metal construct which is constructed for surface mounting on inner wythe 214 and for interconnection with veneer tie 244.

The veneer tie 244 is adapted from the low-profile box Byna-Tie® device manufactured by Hohmann & Barnard, Inc., Hauppauge, N.Y. 11788 under U.S. Pat. No. 6,279,283. The veneer tie 244 is shown in FIG. 8 as being emplaced on a course of bricks 220 in preparation for embedment in the mortar of bed joint 230. In this embodiment, the system includes a folded wall anchor 240 and a canted veneer tie 244.

At intervals along a horizontal line surface 224, folded wall anchors 240 are surface-mounted using masonry mounting hardware 248. In this structure, channels 247 sheathe the interior of mounting hardware 248. The folded wall anchors 240 are positioned on surface 224 at the intervals required by the applicable building codes. The upper legs 254 and lower leg 256 are folded, as best shown in FIG. 9, so that the base surface 258 of the leg portions and the intermediate base surface 260 are substantially coplanar and, when installed, lie in an xy-plane. Upon insertion in insulation 226, the base surfaces 258 and 260 rest snugly against the opening formed thereby and serves to cover the opening precluding the passage of air and moisture therethrough, thereby maintaining the insulation integrity. It is within the contemplation of this invention that a coating of sealant or a layer of a polymeric compound—such as a closed-cell foam—be placed on base surfaces 258 and 260 for additional sealing. With the legs 254 and 256 sheathing the mounting hardware, only two openings in the insulation are required for mounting and the disruption of the insulative integrity is minimized thereby.

In the third embodiment, slotted wing portions 262 thereabout are bent upwardly (when viewing legs 242 as being bent downwardly) from intermediate base 260 for receiving veneer tie 244 therethrough. The dimensional relationship between wall anchor 240 and veneer tie 244 limits the axial or xz-plane movement of the construct. Each veneer tie 244 has a rear leg 264 opposite the bed-joint deposited portion thereof, which rear leg 264 is formed continuous therewith. The slots 266 provide for adjustability and do not restrict the y-axis 236 movement of the anchored veneer. The opening of the slot 266 of wing portions 262 is constructed to be within the predetermined dimensions to limit the z-axis 238 movement in accordance with the building code requirements. The slots 266 are slightly larger horizontally than the diameter of the tie 244. The dimensional relationship of the rear leg 264 to the width of spacing between wing portions 262 limits the x-axis movement of the construct. For positive interengagement, the front legs 268 and 270 of veneer tie 244 are sealed in bed joint 230 forming a closed loop.

The folded wall anchor 240 is seen in more detail in FIGS. 9 and 10. The upper legs 254 and lower leg 256 are folded 180° about end seams 272 and 274, respectively, and then 90° at the inboard seams 276 and 278 respectively, so as to extend parallel the one to the other. The legs 254 and 256 are dimensioned so that, upon installation, they extend through insulation panels 226 and the endpoints 280 thereof abut the exterior surface 124 of masonry block 216. Because the insertion point 282 into insulation 226 of the legs 254 and 256 is sealingly covered by the structure, the water and water vapor penetration into the backup wall is minimal. (There is virtually no heat transfer across the mounting hardware 248 because of the nonconductive washers thereof.)

In the veneer tie shown in FIGS. 8 and 10, a bend is made at a point of inflection 294. This configuring of the veneer tie 244, compensates for the additional strengthening of wall anchor 240 at crossbar 286. Thus, if the bed joint 230 is exactly coplanar with the strengthening crossbar 286 the bent veneer tie 244 facilitates the alignment thereof.

In this embodiment, as best seen in FIGS. 9 and 10, strengthening ribs 284 are impressed into wing portions 262 adjacent and parallel to the base 258 of wall anchor 240. The ribs 284 are substantially parallel to the bail opening 266. When mounting hardware 248 is fully seated, the base surface 258 rests against the face of insulation 226 without any interface with the ribs 284. The ribs 284 strengthen the wall anchor 240 and achieves an anchor with a tension and compression rating of 100 lbf.

In all three embodiments of the wall anchor disclosed herein, an additional advantage of the inboard legs has been found to be less installation-related damage to the insulation covering the inner wythe. The frequent occurrence of an arcuate path of installation with wall anchors having outboard legs does not occur in practice with wall anchors having inboard legs, thus resulting in inherently less gapping of insulation and less opportunity for infiltration of air and moisture.

In the above description of the folded wall anchors of this invention various configurations are described and applications thereof in corresponding anchoring systems are provided. Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A surface-mounted anchoring system for use in the construction of a wall having an inner wythe and an outer wythe, said outer wythe formed from a plurality of successive courses with a bed joint between each two adjacent courses, said inner wythe and said outer wythe in a spaced apart relationship the one with the other forming a cavity therebetween, said inner wythe having an exterior layer selected from a group consisting of insulation, wallboard, and insulation and wallboard, said surface-mounted anchoring system comprising:

a wall anchor constructed from a plate-like body having two major faces being the mounting surface, said mounting surface having a perimeter, and the outer surface, said wall anchor, in turn, comprising:

a pair of leg portions, each extending from said mounting surface of said plate-like body from a location within said perimeter of said mounting surface with the longitudinal axis of each of said leg portions being substantially normal to said mounting surface and having a channel along said axis adapted for sheathing mounting hardware, said leg portions adapted for insertion at a predetermined insertion point into said exterior layer of said inner wythe;

a covering portion formed at said mounting surface of said plate-like body, said covering portion formed from said mounting surface and at least one of said leg portions and adapted to preclude penetration of air, moisture and water vapor into said exterior layer;

an apertured receptor portion adjacent said outer surface of said plate-like body, said apertured receptor portion adapted to limit displacement of said outer wythe toward and away from said inner wythe;

at least one strengthening rib impressed in said plate-like body parallel to said apertured receptor portion; and, a veneer tie threadedly disposed through said apertured receptor portion of said wall anchor and adapted for embedment in said bed joint of said outer wythe to prevent disengagement from said anchoring system.

2. A surface-mounted anchoring system as described in claim 1, wherein said perimeter has two sides and two ends, said pair of leg portions depending from said mounting surface at a position located inward from said sides and said ends of said perimeter to be positioned completely within the perimeter of said mounting surface, said wall anchor strengthened by at least one strengthening rib is constructed to meet a 100 lbf. tension and compression.

3. A surface-mounted anchoring system as described in claim 2, wherein said exterior layer is insulation, each said insertion point in said insulation adapted to accommodate one of said legs and the associated mounting hardware.

4. A surface-mounted anchoring system described in claim 3, wherein each said strengthening rib is impressed to depend from said mounting surface and adapted, upon surface mounting of said wall anchor, to be pressed into said insulation of said inner wythe.

5. A surface-mounted anchoring system as described in claim 4, wherein said inner wythe is a dry-wall construct and wherein each of said pair of leg portions extending from said mounting surface of said plate-like body terminates in at least two points adapting said anchoring system for minimal thermal transfer between said inner wythe and said anchoring system.

6. A surface-mounted anchoring system as described in claim 2, wherein said anchoring system further comprises:

sealant means for further sealing between said plate-like body and said exterior layer.

7. A surface-mounted anchoring system as described in claim 2, wherein said veneer tie further comprises:

an attachment portion for threading through said apertured receptor; and, an insertion portion contiguous with and opposite said attachment portion, said insertion portion being swaged for interconnection with said reinforcement wire;

whereby, upon installation of said anchoring system with an interconnected reinforcing wire in said outer wythe, said system provides a high degree of seismic protection.

8. A surface-mounted anchoring system as described in claim 2, wherein said anchoring system further comprises:

a reinforcement wire disposed in said bed joint.

9. A surface mounted anchoring system as described in claim 8, wherein said veneer tie further comprises:

an attachment portion for threading through said apertured receptor; and, an insertion portion contiguous with and opposite said attachment portion, said insertion portion being swaged for interconnection with said reinforcement wire;

whereby, upon installation of said anchoring system with an interconnected reinforcing wire in said outer wythe, said system provides a high degree of seismic protection.

10. A surface-mounted anchoring system for use in the construction of a wall having an inner wythe and an outer wythe, said outer wythe formed from a plurality of successive courses with a bed joint between each two adjacent courses, said inner wythe and said out wythe in a spaced apart relationship the one with the other forming a cavity therebetween, said inner wythe having an exterior layer selected from a group consisting of insulation, wallboard, and insulation and wallboard, said surface-mounted anchoring system comprising:

a wall anchor constructed from a plate-like body having two major faces being the mounting surface and the outer surface, said wall anchor, in turn, comprising:

a pair of legs, each extending from said mounting surface of said plate-like body from an inboard location thereof with the longitudinal axis of each of said legs being substantially normal to said mounting surface and having a channel along said axis adapted for sheathing mounting hardware, said legs adapted for insertion at a predetermined insertion point into said exterior layer of said inner wythe;

said pair of legs being formed by enfolding end portions of said plate-like body downwardly and inwardly for total bends of approximately 180° each, bending leg portions approximately 90° each to form said leg bases and said legs, forming said channels longitudinally in the bodies of said legs, and swaging said leg bases such that the outer surfaces of said leg bases are brought into a substantially coplanar relationship with said mounting surface of said plate-like body;

a covering portion formed at said mounting surface of said plate-like body, said covering portion formed from said mounting surface and said outer surfaces of said leg bases and adapted to preclude penetration of air, moisture and water vapor into said exterior layer;

an apertured receptor portion adjacent said outer surface of said plate-like body, said apertured receptor portion adapted to limit displacement of said outer wythe toward and away from said inner wythe;

at least one strengthening rib impressed in said plate-like body parallel to said apertured receptor portion; and, a veneer tie threadedly disposed through said apertured receptor portion of said wall anchor and adapted for embedment in said bed joint of said outer wythe to prevent disengagement from said anchoring system;

whereby, upon surface mounting of said wall anchor, said covering portion of said plate-like body seals against the openings in said exterior layer of said inner wythe.

11. A surface-mounted anchoring system as described in claim 10, wherein said wall anchor strengthened by at least one strengthening rib is constructed to meet a 100 lbf. Tension and compression rating.

12. A surface-mounted anchoring system as described in claim 11, wherein said exterior layer is insulation, each said insertion point in said insulation adapted to accommodate one of said legs and the associated mounting hardware.

13. A surface-mounted anchoring system described in claim 12, wherein each said strengthening rib is impressed to depend from said mounting surface and adapted, upon surface mounting of said wall anchor, to be pressed into said insulation of said inner wythe.

14. A surface-mounted anchoring system as described in claim 13, wherein said inner wythe is a dry-wall construct and wherein each of said pair of legs at the end opposite said plate-like body terminates in at least two points adapting said anchoring system for minimal thermal transfer between said inner wythe and said anchoring system.

15. A surface-mounted anchoring system as described in claim 11, wherein said anchoring system further comprises:

sealant means for further sealing between said plate-like body and said exterior layer.

16. A surface-mounted anchoring system described in claim 15, wherein said sealant means is adhered to said exterior layer prior to mounting said wall anchor thereon.

17. A surface-mounted anchoring system as described in claim 16, wherein said sealant means is a coating on said covering portion of said plate-like body.

18. A surface-mounted anchoring system as described in claim 11, wherein said anchoring system further comprises:

a reinforcement wire disposed in said bed joint.

* * * * *